US009914130B2

(12) United States Patent
Burchardt

(10) Patent No.: US 9,914,130 B2
(45) Date of Patent: Mar. 13, 2018

(54) METHOD AND SYSTEM FOR GRINDING FRAGMENTARY STARTING MATERIAL

(71) Applicant: THYSSENKRUPP INDUSTRIAL SOLUTIONS AG, Essen (DE)

(72) Inventor: Egbert Burchardt, Everswinkel (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 480 days.

(21) Appl. No.: 14/764,846

(22) PCT Filed: Jan. 29, 2014

(86) PCT No.: PCT/EP2014/051724
§ 371 (c)(1),
(2) Date: Jul. 30, 2015

(87) PCT Pub. No.: WO2014/118235
PCT Pub. Date: Aug. 7, 2014

(65) Prior Publication Data

US 2015/0367352 A1 Dec. 24, 2015

(30) Foreign Application Priority Data

Jan. 31, 2013 (DE) ..... 10 2013 100 997

(51) Int. Cl.
*B02C 23/08* (2006.01)
*B02C 21/00* (2006.01)

(52) U.S. Cl.
CPC ..... *B02C 23/08* (2013.01); *B02C 21/00* (2013.01); *B02C 21/005* (2013.01)

(58) Field of Classification Search
CPC ..... B02C 21/00; B02C 21/005; B02C 23/08
(Continued)

(56) References Cited

U.S. PATENT DOCUMENTS 1,673,483 A * 6/1928 Barker ..... B02C 17/04 241/176
3,037,624 A * 6/1962 Jackson ..... B03D 1/001 209/11

(Continued)

FOREIGN PATENT DOCUMENTS

DE 3315991 A1 11/1984
DE 2708053 C 5/1986

(Continued)

OTHER PUBLICATIONS

German language International Search Report for International patent application No. PCT/EP2014/051724; dated Apr. 15, 2014.

(Continued)

*Primary Examiner* — Sean Michalski
(74) *Attorney, Agent, or Firm* — thyssenkrupp North America, Inc.

(57) ABSTRACT

Disclosed herein is a method and system for grinding fragmentary starting material, in particular ores, with a dry grinding system. An embodiment of the method includes the steps of determining the moisture of starting material for a certain period of time, preparing at least one screening stage, the cut point of which is selected depending on the determined moisture in such a manner that the moisture of a screen oversize does not exceed a predetermined moisture limit value when starting material having the determined moisture is fed to the screening stage, feeding starting material to the screening stage, transferring a screen oversize arising in the screening stage to the dry grinding system, and grinding the screen oversize in the dry grinding system.

13 Claims, 7 Drawing Sheets

(58) Field of Classification Search
USPC ..... 241/34, 68
See application file for complete search history.

(56) References Cited

U.S. PATENT DOCUMENTS

| | | | | | |
|---|---|---|---|---|---|
| 3,062,458 | A * | 11/1962 | Dearing | B02C 13/13 | 209/138 |
| 3,150,835 | A * | 9/1964 | Horton | C09K 8/145 | 241/16 |
| 3,606,173 | A * | 9/1971 | Rowland, Jr. | C22B 1/14 | 241/17 |
| 3,765,612 | A * | 10/1973 | Wenger | B02C 21/00 | 241/23 |
| 3,770,212 | A * | 11/1973 | Kassir | B02C 19/18 | 241/1 |
| 3,929,293 | A * | 12/1975 | Hahn | B02C 13/04 | 241/189.1 |
| 4,089,259 | A * | 5/1978 | Stickle | B02C 9/04 | 100/92 |
| 4,116,390 | A * | 9/1978 | Wengeler | B02C 21/00 | 241/24.1 |
| 4,357,287 | A | 11/1982 | Schonert | | |
| 4,671,464 | A * | 6/1987 | Karra | B02C 2/00 | 241/21 |
| 4,834,913 | A * | 5/1989 | Aseltine | B01J 8/10 | 241/189.1 |
| 5,529,254 | A * | 6/1996 | McIntyre | B02C 13/284 | 209/409 |
| 5,897,063 | A * | 4/1999 | Patzelt | B02C 21/005 | 241/152.2 |
| 5,908,166 | A * | 6/1999 | Freitas | B02C 21/005 | 241/21 |
| 6,550,700 | B1 * | 4/2003 | Griebat | B02C 9/04 | 241/30 |
| 6,899,294 | B2 * | 5/2005 | MacNeil | A23J 1/08 | 241/24.12 |
| 8,157,193 | B2 * | 4/2012 | Avant, Jr. | B02C 21/00 | 241/14 |
| 8,215,575 | B2 * | 7/2012 | Palin | B01J 20/041 | 241/135 |
| 8,734,547 | B2 * | 5/2014 | Rappas | C10J 3/00 | 241/23 |
| 8,734,548 | B2 * | 5/2014 | Rappas | C10J 3/00 | 241/23 |
| 9,649,666 | B2 * | 5/2017 | Gitschel | B02C 23/08 | |
| 9,676,917 | B1 * | 6/2017 | Tian | C08J 11/06 | |
| 2002/0006461 | A1 * | 1/2002 | Haarasilta | A21D 2/14 | 426/549 |
| 2002/0013254 | A1 * | 1/2002 | Takano | C11D 3/1266 | 510/507 |
| 2002/0043578 | A1 | 4/2002 | Ottergren | | |
| 2004/0094457 | A1 * | 5/2004 | Donaj | B03B 1/04 | 209/162 |
| 2005/0072273 | A1 * | 4/2005 | Burchardt | B02C 4/02 | 75/749 |
| 2005/0167534 | A1 * | 8/2005 | Tomikawa | B02C 17/185 | 241/19 |
| 2007/0029417 | A1 * | 2/2007 | Whittaker | B02C 21/00 | 241/19 |
| 2009/0020636 | A1 | 1/2009 | Schulte et al. | | |
| 2010/0059609 | A1 * | 3/2010 | Teeter, Jr. | B02C 9/04 | 241/11 |
| 2015/0367352 | A1 * | 12/2015 | Burchardt | B02C 21/00 | 241/24.1 |

FOREIGN PATENT DOCUMENTS

| | | | |
|---|---|---|---|
| DE | 19512509 | A | 1/1997 |
| DE | 20211860 | U | 7/2003 |
| DE | 10336801 | A | 3/2005 |
| DE | 102005007254 | A1 | 8/2006 |
| EP | 0292724 | A2 | 11/1988 |
| EP | 0527333 | A1 | 2/1993 |
| EP | 0749782 | A1 | 12/1996 |
| WO | 9306297 | A | 4/1993 |

OTHER PUBLICATIONS

English translation of International Search Report for International patent application No. PCT/EP2014/051724; dated Apr. 15, 2014.
English translation of abstract of DE 102005007254 A1.
English translation of abstract of DE 3315991 A1.
English translation of abstract of EP 0527333 A1.
English translation of abstract of EP 0749782 A1.
English translation of abstract of EP 0292724 A2.
English Language Abstract of DE20211860U.

* cited by examiner

METHOD AND SYSTEM FOR GRINDING FRAGMENTARY STARTING MATERIAL

CROSS REFERENCE TO RELATED APPLICATIONS

This application is a U.S. National Stage Entry of International Patent Application Serial Number PCT/EP2014/051724, filed Jan. 29, 2014, which claims priority to German patent application no. DE 102013100997.2 filed Jan. 31, 2013, the entire contents of both of which are incorporated herein by reference.

FIELD

The invention relates to a method and to a system for grinding fragmentary starting material, in particular ores, with a dry grinding system.

BACKGROUND

In order to grind ores to finished product fineness (P80=30 to 300 μm), use is made nowadays generally of ball mills or sometimes of attritors. Said mills are preferably operated as wet grinding mills. It is furthermore known that dry grinding methods, in particular in roller mills and roll presses, are considerably more efficient with regard to wear and energy consumption than in particular conventional wet grinding mills. Said two technologies (roller mill and roll press) have hitherto frequently been considered to be uneconomical for final grinding in mineral applications since it is assumed that the ore is frequently present with more than 2 to 5% moisture and then has to be dried for efficient grinding and sizing in a roller mill or roll press. However, in the case of moist feed materials, required thermal drying of the feed material is associated with high costs which would again negate the operating cost advantages afforded by the lower wear and the reduced electrical energy if drying were not required in any case for the subsequent process. Drying is economically inexpedient in particular if the ground material has to be further processed in the subsequent process in wet form.

SUMMARY

The invention was then based on the object of specifying a method and a system for grinding fragmentary starting material, in particular ores having more than 2 to 5% moisture, wherein the costs for wear and electrical energy are reduced.

BRIEF DESCRIPTION OF THE DRAWINGS

The present disclosure is described in detail below with reference to the attached drawing figures, wherein.

DETAILED DESCRIPTION

Figure 1:
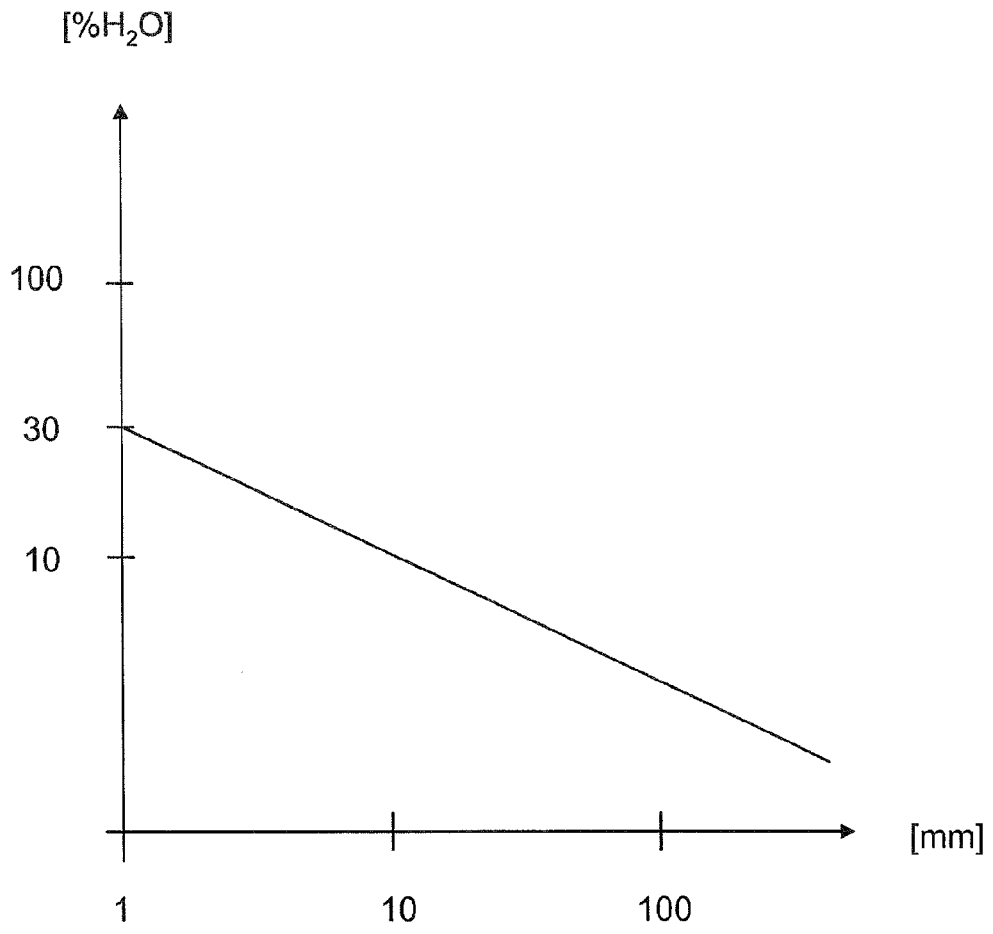
FIG. 1 is a graph showing a characteristic curve illustrating the relationship between moisture of the screen oversize and the cut point.

The method according to the invention for grinding fragmentary starting material, in particular ores, with a dry grinding system is characterized by the following method steps:

- Determining the moisture of starting material for a certain period of time,
- Preparing at least one screening stage, the cut point of which is selected depending on the determined moisture in such a manner that the moisture of a screen oversize does not exceed a predetermined moisture limit value when starting material having the determined moisture is fed to the screening stage,
- Feeding starting material to the screening stage,
- Transferring a screen oversize arising in the screening stage to the dry grinding system, and
- Grinding the screen oversize in the dry grinding system.

The system according to the invention for grinding fragmentary starting material substantially consists of

- a dry grinding system,
- a wet grinding system, and
- at least one screening stage which has a screen oversize outlet connected to the dry grinding system and a screen undersize outlet connected to the wet grinding system, wherein the screening stage has a cut point which is defined depending on a determined moisture of a starting material in such a manner that the moisture of a screen oversize does not exceed a predetermined moisture limit value when starting material having the determined moisture is fed to the screening stage.

According to a further refinement of the invention, the system according to the invention for grinding fragmentary starting material substantially consists of

- a dry grinding system,
- a drying device, and
- at least one screening stage which has a screen oversize outlet connected to the dry grinding system and a screen undersize outlet connected to the drying device, wherein the screening stage has a cut point which is defined depending on a determined moisture of a starting material in such a manner that the moisture of a screen oversize does not exceed a predetermined moisture limit value when starting material having the determined moisture is fed to the screening stage.

The invention makes use of the finding that the moisture in a starting material adheres to an increased extent to the finer grain portions. In other words, the coarse-grained portion in the starting material has less moisture than the fine-grained portion thereof. By providing a screening stage with a suitable cut point, it is therefore possible to adjust the moisture of the screen oversize in such a manner that energy-efficient dry grinding, in particular in a roller mill or roll press is possible. Only the screen undersize therefore has to be processed in the conventional manner.

The determination of the moisture of starting material for a certain period of time as claimed in the first characterizing feature of claim 1 serves merely for selecting the screening stage with a suitable cut point in order to ensure that the screen oversize does not exceed a predetermined moisture limit value. For this purpose, the maximum moisture of the starting material present is expediently determined for a certain period of time of several minutes, hours, days, weeks or months. The suitable cut point for the screening stage is then defined with reference to the data determined, wherein the cut point, firstly, should be selected to be as small as possible, but, secondly, it is ensured that the screen oversize moisture arising in comparable starting material does not exceed a predetermined moisture limit value. The predetermined moisture limit value is predetermined here by the dry grinding system. The moisture limit value is expediently selected here to be as high as possible in order also to ensure satisfactory grinding of corresponding starting material.

Further refinements of the invention are the subject matter of the dependent claims.

For the further processing of the screen undersize, a wet grinding system is proposed according to a first variant, and a drying device with subsequent grinding in the dry grinding system is proposed in a second variant.

In addition to the determination of the moisture for a certain period of time, in order to define a suitable cut point for the screening stage, it is also conceivable, according to a further refinement of the invention, that the moisture of the feedstock to be ground is additionally measured online and the starting material is supplied to the screening stage if the moisture of the starting material exceeds the predetermined moisture limit value, and the starting material is supplied directly to the dry grinding system if the predetermined moisture limit value is not exceeded.

Furthermore, it is conceivable that a plurality of screening stages having different cut points are provided and the moisture of the feedstock is measured online, wherein the starting material is supplied depending on the moisture thereof determined online to that screening stage having the smallest cut point, the screen oversize of which has a moisture which does not exceed the predetermined moisture limit value. By means of this arrangement, the portion of the starting material which is supplied to the dry grinding system can be maximized in the event of greatly fluctuating moisture values of the starting material. Therefore, if it is ascertained, during the determination of the moisture of the starting material for a certain period of time, that the moisture is subject to relatively great fluctuations, either use would have to be made of a screening stage which takes the maximum moisture into account, or use is made of a plurality of screening stages having different cut points such that, in the event of a batch of starting material having a lower amount of moisture, a greater portion can be transferred to the dry grinding system. However, the use of a plurality of stages requires online measurement of the moisture of the feedstock.

A ball mill, a roller miller or a roll press, which are suitable in particular for predetermined moisture limit values within the range of 2 to max. 5% by weight, are suitable in particular as the dry grinding system.

The screening stage can in principle be designed to be either wet or dry. Even in the case of wet screening, the screen oversize is always drier than the starting material fed to the screening stage. The characteristic curve according to FIG. 1 shows as an illustration the moisture content of the screen oversize depending on the cut point, in mm. This relationship applies both for dry screening and for wet screening.

The starting material, which may be, for example, ores of iron, copper, gold, molybdenum, silver or polymetal, etc., is ground in the dry grinding system and optionally in the wet grinding system to a grain size ≤300 μm, in particular to a finished product fineness of P80 (30 to 300 μm).

The present disclosure will be discussed in further detail below with reference to the attached drawing figures.

Figure 2:
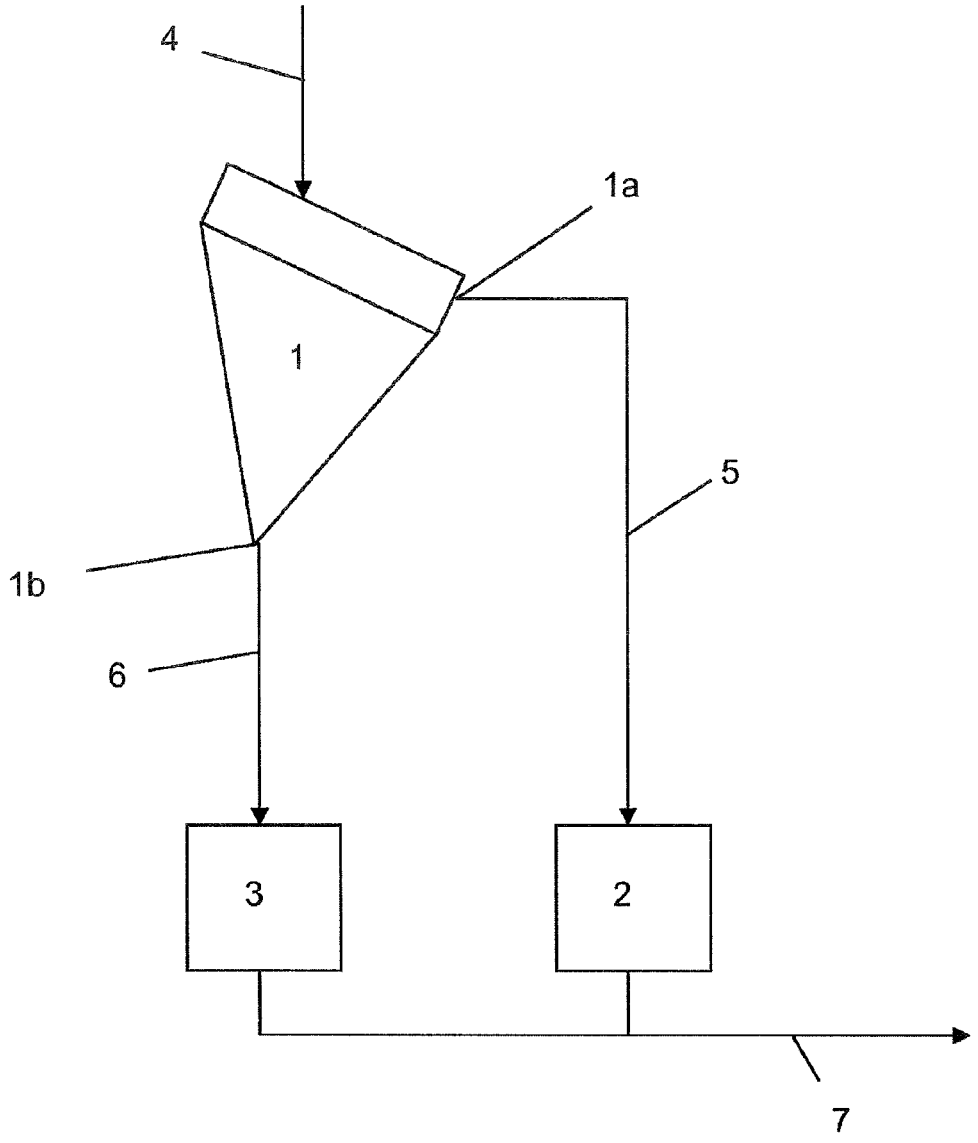
FIG. 2 is a schematic block diagram of an embodiment of a system of the present disclosure.

The system illustrated in FIG. 2 for grinding fragmentary starting material 4, in particular ore, has a screening stage 1, a dry grinding system 2 and a wet grinding system 3. The screening stage 1 provides a screen oversize outlet 1*a* which is connected to the dry grinding system 2 for the supply of a screen oversize 5. A screen undersize outlet 1*b* is connected to the wet grinding system 3 for the supply of a screen undersize 6. The product ground in the dry grinding system 2 and in the wet grinding system 3 is removed as finished product 7 and has in particular a finished product fineness of ≤300 μm. The dry grinding system 2 is, for example, a ball mill, a roller mill or a roll press. Suitable examples of a wet grinding system include a ball mill or an attritor.

The dry grinding system 2 used defines a predetermined moisture limit value $\psi_G$ which also permits an expedient comminution of the screen oversize 5 in the dry grinding system 2. The screening stage 1 has a cut point which is selected on the basis of experimental values in such a manner that the moisture of the resulting screen oversize 5 does not exceed the moisture limit value $\psi_G$ predetermined by the dry grinding system 2. In order to select the correct cut point, a moisture measurement of the starting material for a certain period of time is therefore resorted to. The maximum moisture determined or a somewhat lower value is expediently selected here as the basis for the selection of the cut point. For the selection of the cut point, for example, a characteristic curve assigned to the screening stage, as per FIG. 1, can be resorted to here.

As soon as the suitable screening stage is provided, the actual grinding of fragmentary starting material 4 can take place by the starting material first of all being fed to the screening stage 1. The screen oversize 5 passes into the dry grinding system 2 while the screen undersize 6 is ground to form the finished product 7 in the wet grinding system 3. Since the dry grinding system 2 operates substantially more efficiently than a wet grinding system with regard to wear and energy consumption, a significant improvement with regard to wear and energy consumption can be achieved by the system according to the invention. The saving depends, of course, primarily on the moisture of the starting material 4. The improvement is all the more greater, the lower the amount by which the moisture exceeds the predetermined moisture limit value $\psi_G$ for the dry grinding system 2.

In the exemplary embodiments below, the same reference numbers are used for identical components in order to facilitate the comparison and the comprehension.

Figure 3:
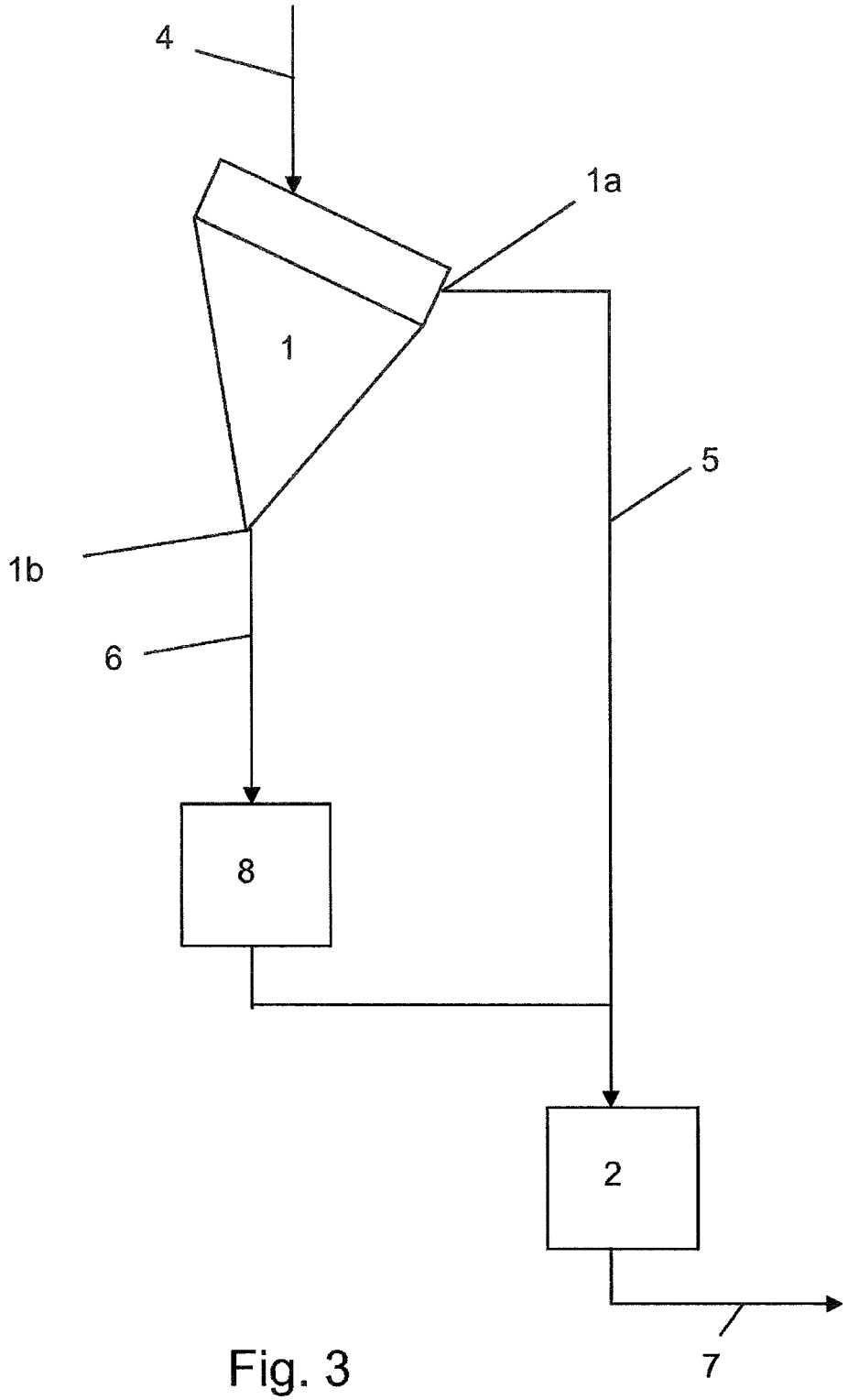
FIG. 3 is a schematic block diagram of a second embodiment of a system of the present disclosure.

In place of the wet grinding system 3, the second exemplary embodiment according to FIG. 3 provides a drying device 8 in which the screen undersize 6 is dried to below the predetermined moisture limit value $\psi_G$ of the dry grinding system 2 and is then supplied to the dry grinding system 2. This variant is suitable especially whenever the finished product 7 produced is further processed in dry form.

Figure 4:
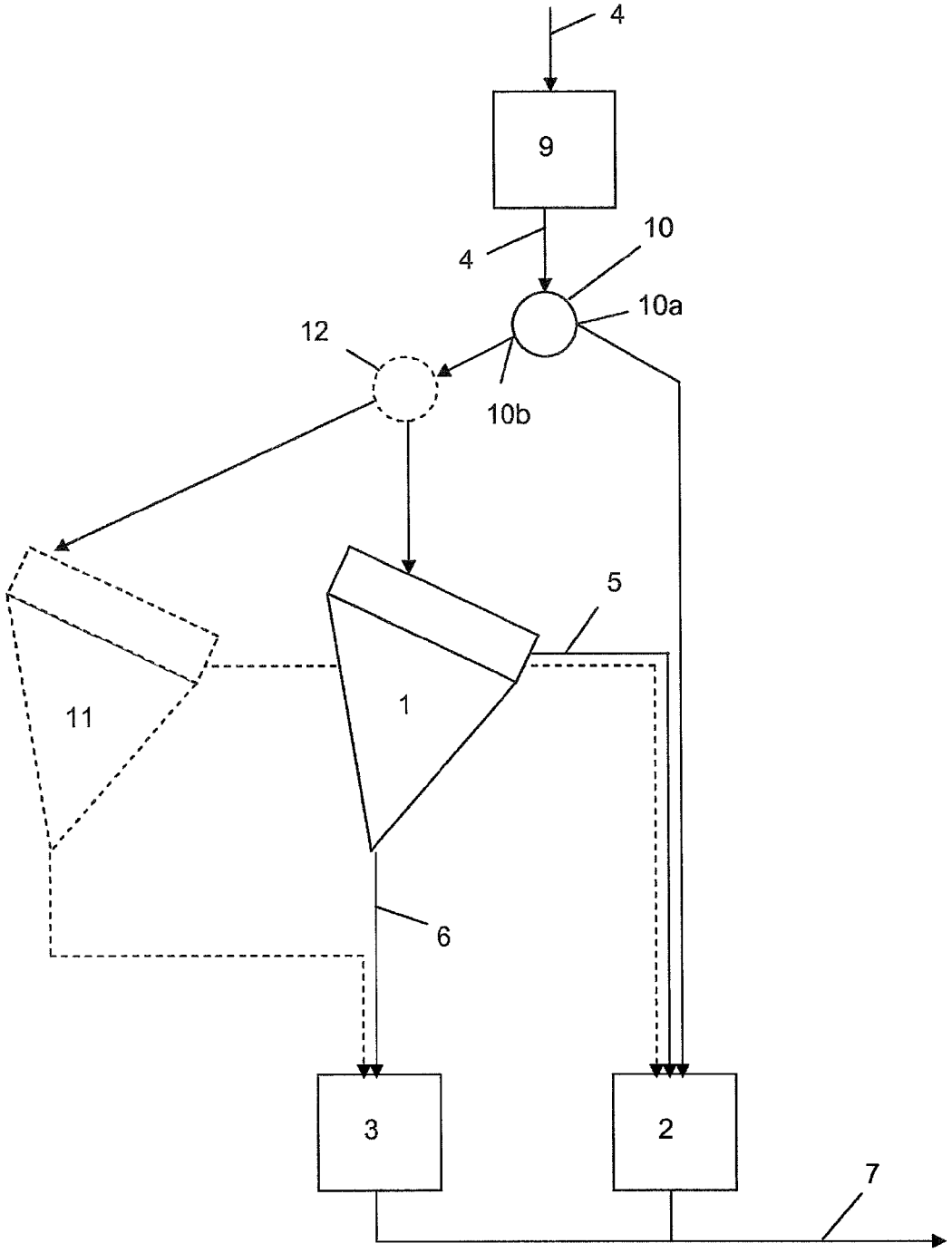
FIG. 4 is a schematic block diagram of a third embodiment of a system of the present disclosure.

The design of the system according to FIG. 4 substantially corresponds to the first exemplary embodiment (FIG. 2). In addition, there is a moisture measuring device 9 which permits online moisture measurement of the starting material 4 to be ground. Following the moisture measuring device 9, the starting material 4 passes into a material sorting gate 10 which is switchable between at least one first and one second output 10*a*, 10*b*, wherein the first output 10*a* is connected directly to the dry grinding system 2 and the second output 10*b* is connected to the at least one screening stage 1. By means of the additional moisture measuring device 9 and the material sorting gate 10, it is possible, depending on the moisture, measured online, of the starting material 4, to supply the starting material to the screening stage 1 if the moisture of the starting material exceeds the predetermined moisture limit value $\psi_G$, and to supply the starting material directly to the dry grinding system if the predetermined moisture limit value is not exceeded. The customary separation into screen oversize 5 and screen undersize 6 then takes place in the screening stage 1, in accordance with the exemplary embodiment of FIG. 2.

At least one further screening stage 11 can optionally be provided, wherein the two screening stages 1, 11 have different cut points. There is then the possibility, via a further material sorting gate 12, to supply the starting material 4, depending on the moisture thereof determined online, to that screening stage 1 or 11 having the smaller cut point such that the screen oversize thereof has a moisture which does not exceed the predetermined moisture limit value $\psi_G$.

If the moisture, measured online, of the starting material 4 exceeds the moisture limit value $\psi_G$, the material is conducted to the material gate 12. If the moisture, measured online, exceeds a moisture $\psi_{11}$, the material is conducted to the screening stage 11. If the moisture merely reaches a value $\psi_1$, the material is conducted to the screening stage 1, wherein $\psi_{11}>\psi_1>\psi_G$.

The screening stage 11 is therefore configured for particularly moist starting material 4 and therefore has a greater cut point than the screening stage 1. A greater cut point signifies a correspondingly coarser screen. Of course, instead of the use of two material gates 10, 12, one material gate having correspondingly three outputs could also be provided.

Figure 5:
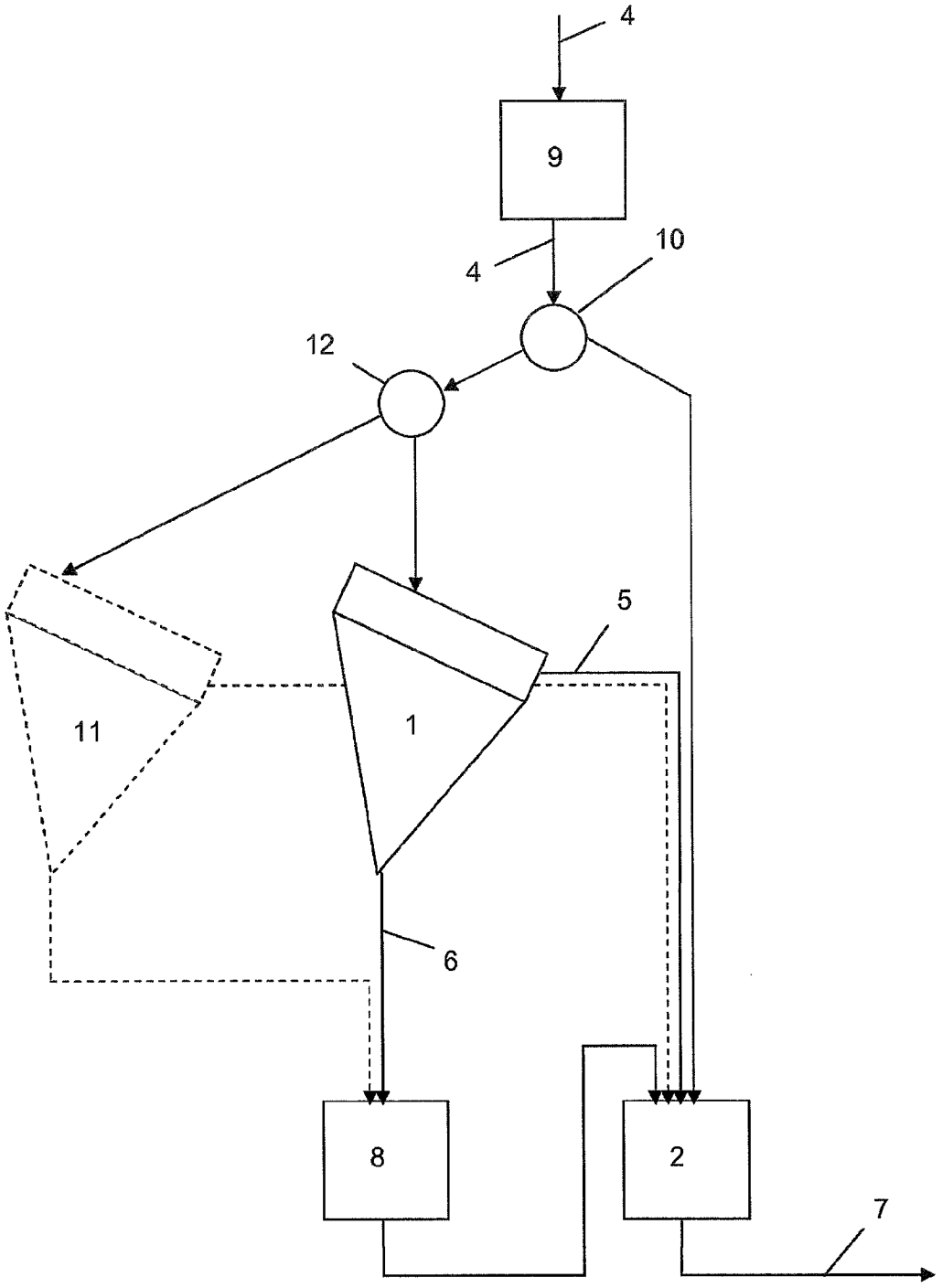
FIG. 5 is a schematic block diagram of a fourth embodiment of a system of the present disclosure.

The exemplary embodiment according to FIG. 5 substantially corresponds to the exemplary embodiment of FIG. 4, but wherein, instead of the wet grinding system 3, the drying device 8, as has already been described in the exemplary embodiment of FIG. 3, is again provided.

Figure 6:
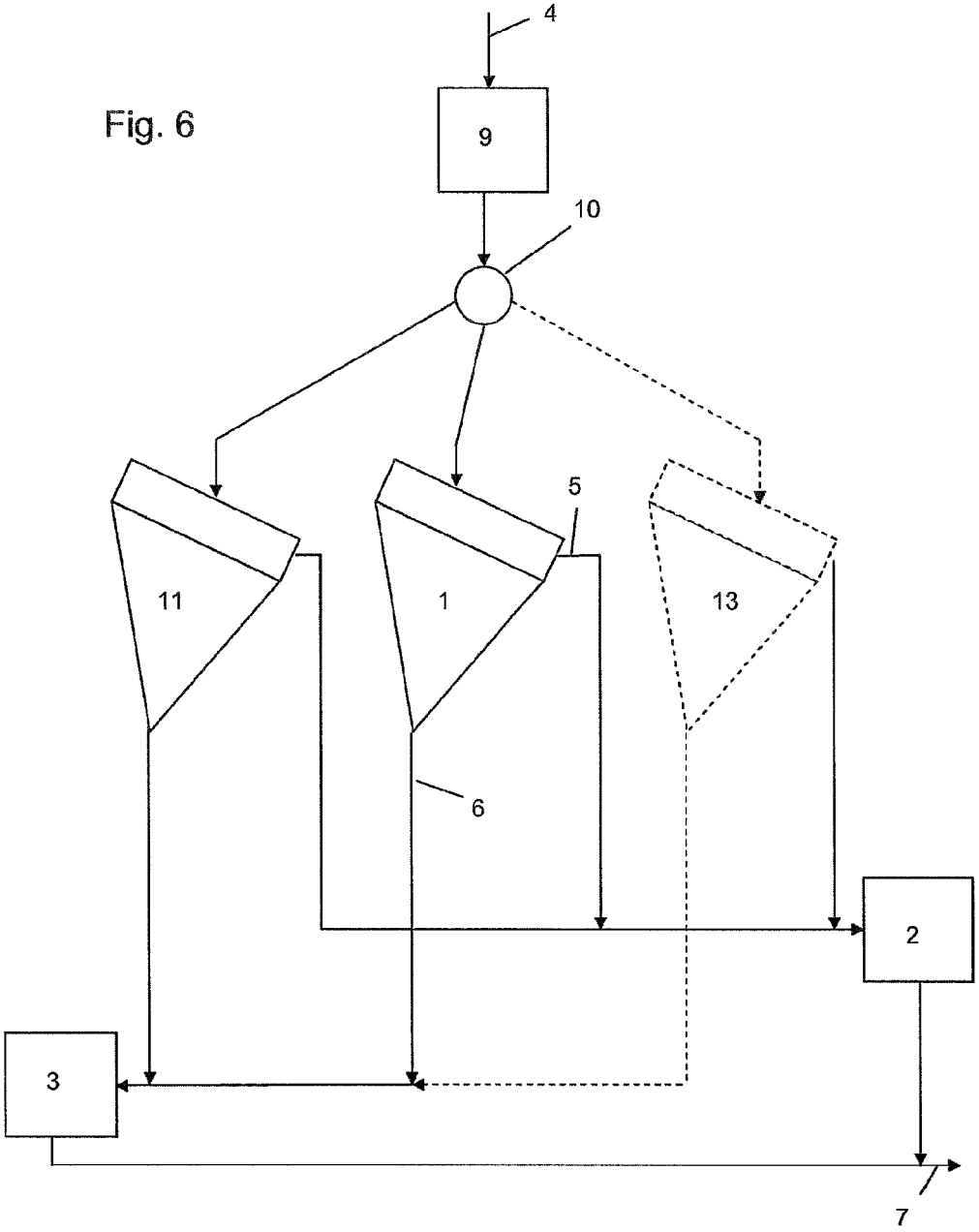
FIG. 6 is a schematic block diagram of a fifth embodiment of a system of the present disclosure.

FIG. 6 shows a variant which substantially corresponds to the exemplary embodiment of FIG. 4, but wherein the starting material 5 cannot be fed directly to the dry grinding system 2. On the contrary, all of the material is fed via the material gate 10 into one of at least two screen stages 1, 11. A third or further screening stages 13 can optionally also be provided. Depending on the moisture, measured online, in the moisture measuring device 9, the starting material 4 is fed optionally to one of the screening stages 1, 11 or 13, which in turn have different cut points, wherein that screening stage is selected which has the smallest cut point, the screen oversize of which still has a moisture which does not exceed the predetermined moisture limit value $\psi_G$ for the dry grinding system 2. The screen undersize is in turn reduced in a wet grinding system 3.

Figure 7:
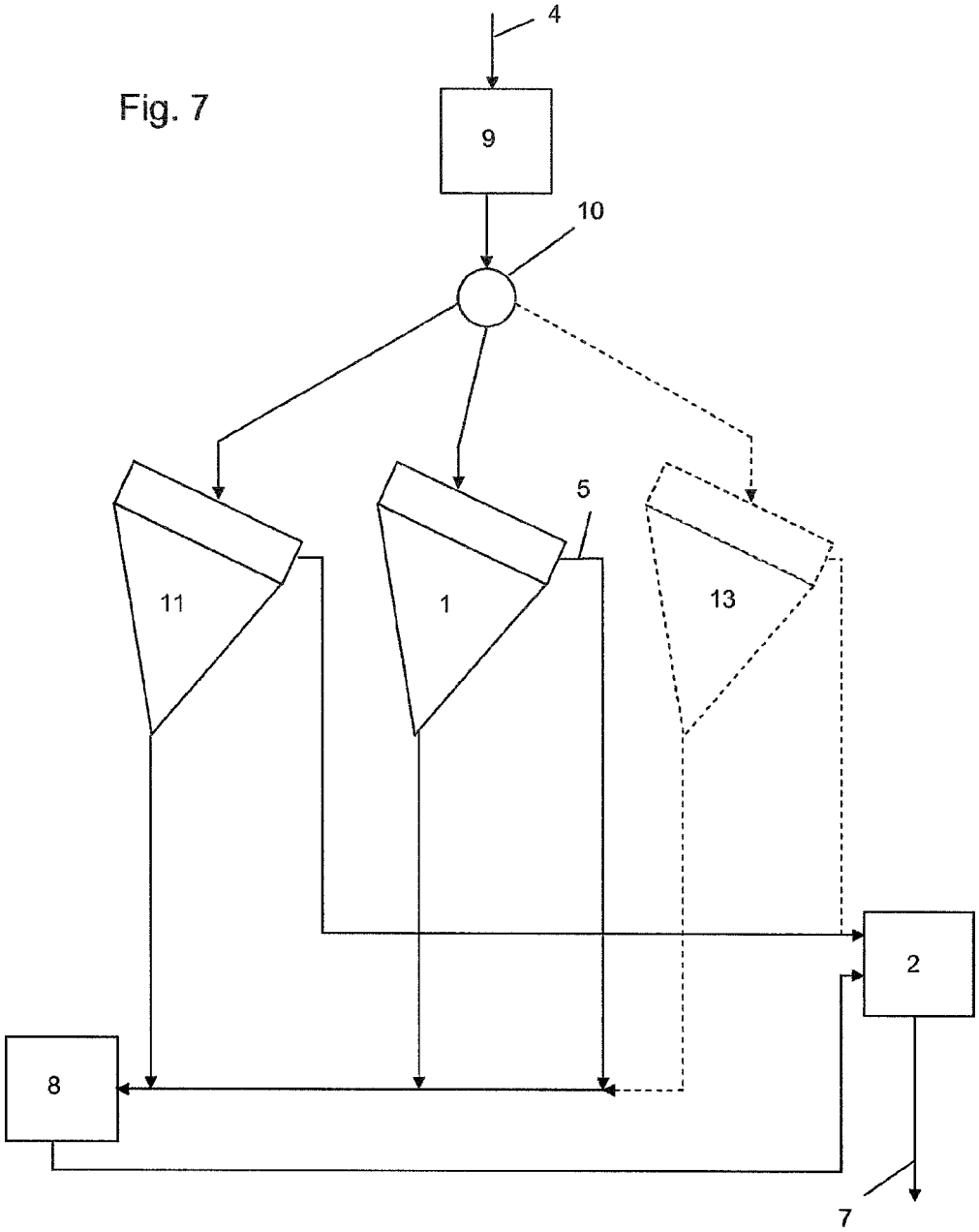
FIG. 7 is a schematic block diagram of a sixth embodiment of a system of the present disclosure.

The exemplary embodiment illustrated in FIG. 7 substantially corresponds to the exemplary embodiment according to FIG. 6, wherein the drying device 8 is provided instead of the wet grinding system 3, and therefore all of the material is comminuted in the dry grinding system 2.

The invention claimed is:

1. A method for grinding fragmentary starting material, in particular ores, with a dry grinding system, the method comprising:

determining the moisture of starting material for a certain period of time;

preparing at least one screening stage, the cut point of which is selected depending on the determined moisture in such a manner that the moisture of a screen oversize does not exceed a predetermined moisture limit value ($\psi_G$) when starting material having the determined moisture is fed to the screening stage;

feeding starting material to the screening stages;

transferring a screen oversize arising in the screening stage to the dry grinding system; and grinding the screen oversize in the dry grinding system.

2. The method of claim 1, wherein a screen undersize arising in the screening stage is supplied to a wet grinding system.

3. The method of claim 1, wherein a screen undersize arising in the screening stage is supplied to a drying device and subsequently to the dry grinding system.

4. The method of claim 1, wherein the moisture of the feedstock to be ground is measured online and the starting material is supplied to the screening stage if the moisture of the starting material exceeds the predetermined moisture limit value ($\psi_G$), and the starting material is supplied directly to the dry grinding system if the predetermined moisture limit value ($\psi_G$) is not exceeded.

5. The method of claim 1, wherein a plurality of screening stages having different cut points are provided and the moisture of the feedstock is measured online, wherein the starting material is supplied depending on the determined moisture thereof is supplied to that screening stage having the smallest cut point, the screen oversize of which has a moisture which does not exceed the predetermined moisture limit value ($\psi_G$).

6. The method of claim 1, wherein the predetermined moisture limit value ($\psi_G$) is between about 2% to about 8% by weight.

7. The method of claim 1, wherein a ball mill, roller mill or roll press, in which that portion of the starting material which does not exceed the predetermined moisture limit value ($\psi_G$) is ground, is provided as the dry grinding system.

8. The method of claim 1, wherein the starting material is ground to a grain size of ≤600 μm.

9. The method of claim 1, wherein the at least one screening stage is operated dry or wet.

10. A system for grinding fragmentary starting material, comprising:

a dry grinding systems;

a wet grinding systems; and at least one screening stage which has a screen oversize outlet connected to the dry grinding system and a screen undersize outlet connected to the wet grinding system, wherein the screening stage has a cut point which is defined depending on a determined moisture of a starting material in such a manner that the moisture of a screen oversize does not exceed a predetermined moisture limit value ($\psi_G$) when starting material having the determined moisture is fed to the screening stage.

11. The system of claim 10, further comprising a moisture measuring device and at least one material gate, which material gate is arranged downstream of the moisture measuring device and is switchable between at least one first and one second output, wherein the first output is connected directly to the dry grinding system and the second output is connected to the at least one screening stage.

12. The system of claim 11, wherein said at least one screening stage comprises a plurality of screening stages having different cut points, and the material gate has such a multiplicity of switchable outputs that said material gate can be coupled either directly to the dry grinding system or to one of the screening stages.

13. A system for grinding fragmentary starting material, comprising:

a dry grinding system;

a drying device; and at least one screening stage which has a screen oversize outlet connected to the dry grinding system and a screen undersize outlet connected to the drying device, wherein the screening stage has a cut point which is defined depending on a determined moisture of a starting material in such a manner that the moisture of a screen oversize does not exceed a predetermined moisture limit value ($\psi_G$) when starting material having the determined moisture is fed to the screening stage.

* * * * *